United States Patent [19]

Bartneck

[11] Patent Number: 4,823,420

[45] Date of Patent: Apr. 25, 1989

[54] CONTOUR MOLDED INSOLE

[76] Inventor: Hans Bartneck, 291 Ferry Landing, Sanibel, Fla. 33957

[21] Appl. No.: 937,881

[22] Filed: Dec. 4, 1986

[51] Int. Cl.[4] ..... A43B 13/40; A43B 13/38

[52] U.S. Cl. ..... 12/142 N; 12/146 M; 36/44

[58] Field of Search ..... 36/43, 44, 88, 91, 92, 36/93, 71, 76 C; 128/595; 12/146 M, 142 N

[56] References Cited

U.S. PATENT DOCUMENTS

| | | | |
|---|---|---|---|
| 3,825,017 | 7/1974 | Scrima | 36/44 |
| 3,859,740 | 1/1975 | Kemp | 36/71 |
| 3,895,405 | 7/1975 | Edwards | 36/43 |
| 4,520,581 | 6/1983 | Irwin et al. | 36/44 |
| 4,597,196 | 7/1986 | Brown | 36/43 |
| 4,603,493 | 8/1982 | Eston | 36/44 |
| 4,654,984 | 4/1987 | Brown | 36/44 |
| 4,669,142 | 6/1987 | Meyer | 36/44 |

FOREIGN PATENT DOCUMENTS

| | | | |
|---|---|---|---|
| 0118319 | 9/1984 | European Pat. Off. | 36/44 |

*Primary Examiner*—Steven N. Meyers
*Attorney, Agent, or Firm*—Eric P. Schellin

[57] ABSTRACT

A contour molded insole for footwear and method for producing the same to conform to an individual's foot includes at least one layer of material which is provided with plasticity for permitting shaping of the insole. An insole blank is shaped to include an upwardly concave surface portion which, under pressure, is caused to invert to form a convex surface. The insole is provided with a heelbone relief portion and layers of textile and cushioning material for completing a preferred embodiment.

3 Claims, 1 Drawing Sheet

CONTOUR MOLDED INSOLE

This invention relates to insoles for footwear such as boots, shoes and sandals and, more particularly, insoles which are shaped to closely approximate the contour of the bottom side of an individual's foot. Also included in the present invention is a method of forming such a contour molded insole.

BACKGROUND OF THE INVENTION

For many years insoles have been produced to simulate the bottom contour of the human foot in an effort to provide the wearer with a greater degree of comfort, supporting the arch and reducing the shock of impact while walking, running or jumping.

The methods and materials employed were laminated insole boards which were compression molded as in conventional shoemaking, cast and cured natural latex foams, injection molded or open mold cast polyurethane foams, elastiomeric polymers, compression molded crosslinked polyethylene foams, cut and skived foam components from sheet stock, leather and various combinations thereof.

Such insoles all have one basic concept in common, they are all made over, or in, molds which for practical and economical reasons hav a limited number of sizes, often as few as four, seldom more than about eight to twelve. It is therefore understandable that a limited number of molds will necessitate compromise in design and detail for fear of creating pressure points and discomfort to the individual's feet.

It is however a well known fact that the shape and size of the human foot shows an infinite number of variables, and that not even the right and left foot of an individual are exactly the same.

SUMMARY OF THE INVENTION

It is therefore the principal object of the present invention to provide an improved contour molded insole and a novel method of producing such a contoured insole tailored to the individual's feet.

Another object of the invention is to provide an insole which will readily and accurately mold itself to the bottom contour of an individual's foot.

A further object of the invention is to provide a novel negative contour or upwardly concave shape as part of the insole assembly.

Another object of the invention is to provide an insole assembly where at least one part can be activated by molecular oscillation or by chemical means to allow the soft assembly to mold itself to the foot while inside the shoe, boot or sandal.

Another object of the invention is to provide an insole assembly which will easily shape itself to the foot, but will not degrade or soften under elevated temperatures encountered in high performance activities such as may occur during participation in sporting events including basketball, baseball, football, tennis, jogging, marathon running, and the like.

Another object of the invention is to provide an insole with a novel heelbone relief which diminishes the impact shock when walking, running or jumping.

A further object of the invention is to provide an insole blank for use in making an insole for footwear; the insole blank comprising a heel portion and an arch portion having a foot side and a street side; the street side including a generally U-shaped portion extending generally along the perimeter of the blank around the heel portion and through the arch portion for providing the street side with an upwardly concave surface.

A still further object of the invention is to provide a method of forming an insole for footwear wherein the insole accurately conforms to the bottom contour of an individual's foot, the method comprising the steps of providing a layer of moldable material, imparting plasticity to the layer of moldable material, and forcing the layer of moldable material against the bottom of the individual's foot until the plasticity is diminished.

Additional objects of the invention will become apparent to those skilled in the art after considering the drawing and the accompanying description of preferred embodiments of the invention.

DETAILED DESCRIPTION OF THE INVENTION

Figure 1:
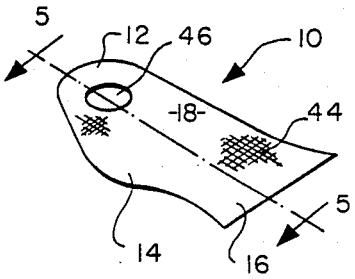
FIG. 1 is a perspective of the top side, i.e., the foot side, of a blank or preform used in forming an insole for footwear.

An insole blank, generally indicated by the numeral 10, includes a heel portion 12, an arch portion 14 and a forward or front portion 16 which extends just forwardly of arch portion 14. Insole blank 10 is constructed to form an insole for the left foot for shoes, boots, sandals and the like and includes a substantially flat, planar top or foot side 18.

Figure 2:
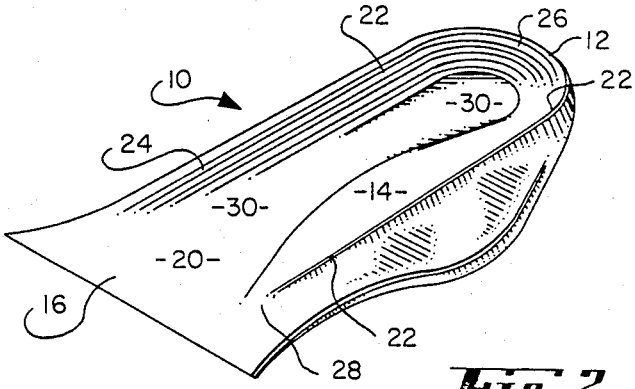
FIG. 2 is an enlarged perspective view of the blank of FIG. 1 and shows the street side of the blank having a concave, or negative, contoured surface and a thickened arch portion.

Insole blank 10 has an underside or street side 20 and, is shown in FIG. 2, includes a generally U-shaped, thickened rib portion 22 extending generally along the perimeter of insole blank 20 and includes a tapered thin portion 24 which gradually thickens as it extends from near front portion 16, extends around a back portion 26 at heel portion 12, and extends through arch portion 14 and gradually thins again, at 28, as it approaches front portion 16. The thickened rib portion 22 defines and encloses an elongated negative contour or concave portion 30 which extends generally centrally of blank 10 from adjacent heel portion 12 and along arch portion 14.

Figure 3:
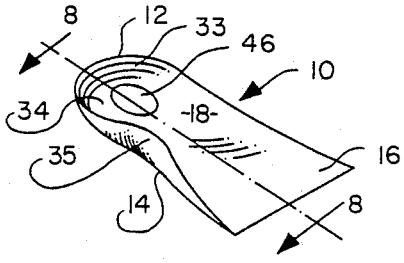
FIG. 3 is a perspective view and illustrates an insole formed from a blank of the type shown in FIG. 1 after the blank has been reshaped to conform to the contour of an individual's foot.
Figure 4:
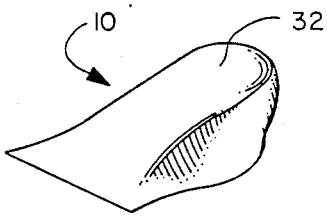
FIG. 4 is a perspective view of the street side of the insole shown in FIG. 3 and illustrates that the concave, or negative, contoured surface, as shown in FIG. 2, has been inverted to provide a convex, or positive, contour.

FIGS. 3 and 4 shown insole blank 10 after it has been reshaped to fit the contour of an individual's foot by a reshaping process to be later described. When an individual's foot is applied to insole blank 10, the weight, or pressure, causes the foot side 18 to be depressed downwardly and rib portion 22 supports the perimeter while the negative contour or concave portion 30 is depressed and becomes inverted to form a positive contour portion 32 as is best shown in FIG. 4, while the foot side 18 becomes depressed and acquires a negative contour or concave shape 34 which is particularly evident adjacent the central portion of heel portion 12 as is best shown in FIG. 3. Heel portion 12 and arch portion 14 acquire an upwardly turned configuration, as is best evident in FIG. 3 and results in blank 10 being conformed to the individual's foot (not shown). It is, of course, to be understood that the final configuration of the contoured portion 32 (see FIG. 4) and the upward "curl" of heel portion 12, at 33, and at arch portion 14, at 35, (see FIG. 3) are dependent upon the particular shape of the inside surface of boot, shoe or sandal (not shown).

Figure 5:
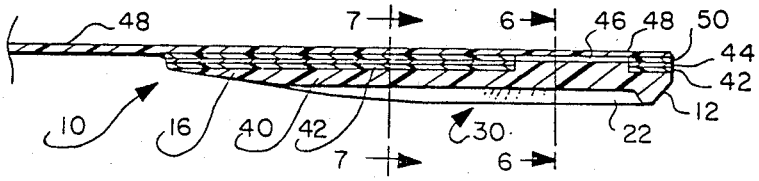
FIG. 5 is an enlarged sectional view taken on line 5—5 of FIG. 1, and illustrates the insole blank and the various layers of material in one form of the invention which includes the addition of an upper layer of cushioning material for being engaged by an individual's foot and a concave undersurface of the insole blank.

As is best shown in FIG. 5, a preferred embodiment of insole blank 10 comprises a laminated construction including a shaped preform or layer 40 comprised of moldable material which may be cushion matter formed of polyurethane, cured latex foam, molded crosslinked polyethylene foam. Preform 40 includes front portion 16, heel portion 12 and rib portion 22 which defines the negative contour or concave portion 30. Affixed and superimposed on shaped preform 40 is a moldable layer 42 formed of a moldable sheet or coating of moldable material, such as thermoplastic material, which can be activated by heat or chemicals to soften and temporarily acquire plasticity allowing the insole blank 10 to be reshaped or molded to the contour of an individual's foot. A layer of textile material 44, such as woven gauze or cloth, covers the moldable layer 42 and completes a preferred embodiment of insole blank 10. An important part of the invention is the provision of an opening 46, formed in moldable layer 42 and textile material 44, to provide a heelbone relief portion, in a central section of heel portion 12, and functions to diminish impact shock when walking, running or jumping.

As is shown in FIG. 5, a complete insole assembly may include an overall layer of foamed cushioning material 48 which can be secured to the textile material 44 by a glue or adhesive layer 50. If desired, layer 48 may be formed from synthetic material or leather.

Figure 8:
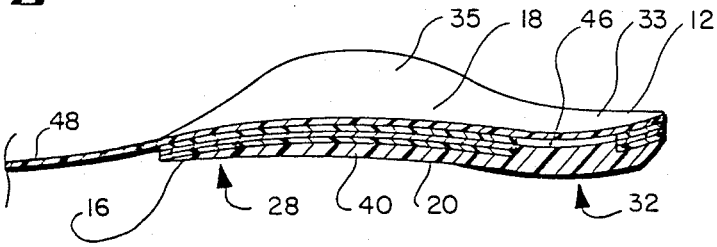
FIG. 8 is a longitudinal sectional view of an insole that has been shaped from the insole blank of FIG. 5 and illustrates inversion of the concave undersurface or streetside of the insole blank.
Figure 6:
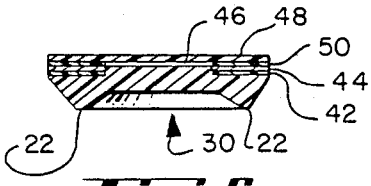
FIG. 6 is a transverse sectional view of the heel portion of the insole blank taken on line 6—6 of FIG. 5, and illustrates a heelbone relief portion formed therein.
Figure 7:
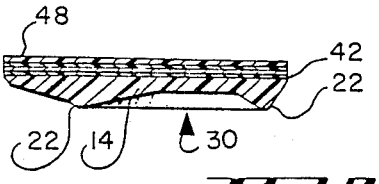
FIG. 7 is a transverse sectional view, taken on line 7—7 of FIG. 5, and illustrates the thickened arch portion and upwardly concave contour of the insole blank.

FIG. 8 shows the final insole assembly following a shaping operation to be hereinafter described. A comparison of FIG. 8 with FIG. 5 illustrates that the negative contour or concave portion 30 has been inverted to produce a positive contour or convex portion 32. The foot side 18 has been depressed and provides an upward curl 33 at heel portion 12 and an upward curl 35 at arch portion 14 to conform the insole to the individual's foot. The individual's heel is supported within the cup-shaped depression formed at heel portion 12 and the individual's heelbone is disposed over relief opening 46 in the layer of moldable material 42 and supported by cushioning material in layer 40.

The layer of moldable material 42 preferrably softens at a temperature if about 170° F. or higher. This temperature is above those which can be experienced in high activity sports such as basketball, football, tennis, jogging, baseball, or marathon running and the like, which may subject the insole to temperatures around 120° F. The moldable material will retain its contoured shape and not be undesirably deformed.

The insole blank 10 may be inserted into footwear or may be formed as an integral part thereof. Plasticity is created in moldable layer 42 by application of heat such as through ultraviolet lamps, immersion in hot air, or by using volatile solvents or plasticisors to temporarily provide a softening action. The individual's foot, or feet, are forced against the insole blank 10, preferrably by standing thereon to equally distribute weight, and the blank 10 conforms to a precise, individual fit to each foot. After the moldable material cools below its softening temperature, or the solvents volatize, the insole assembly will retain its desired shape with the foot side 18 having a negative or concave contour and the street side 20 having a slightly positive or convex contour.

From the foregoing, it will be understood that a preferred embodiment of a molded contour insole and a preferred method for forming the same have been disclosed. It is to be understood, however, that the spirit and scope of the invention is not to be limited by the foregoing description but only by the following claimed subject matter.

We claim:

1. The method of forming an insole for footwear wherein said insole accurately conforms to the bottom contour of an individual's foot, said method comprising the steps of: providing a preform of resilient cushioning material (40) having a heel portion and an arch portion with an upwardly concave portion formed on the underside of said heel portion; providing a layer of moldable material (42) in overlying relation to said preform; imparting plasticity to said layer of moldable material; and forcing said layer of moldable material against the bottom of said individual's foot until said plasticity is diminished.

2. The method defined in claim 1 including the step of inserting said preform and said layer of moldable material into a piece of footwear prior to the step of forcing said layer of moldable material against said individual's foot.

3. The method as defined in claim 2 wherein the step of forcing said layer of moldable material includes having said individual stand on said layer and said preform and imparting a force strong enough for inverting said upwardly concave surface into a convex surface in contact with said footware.

* * * * *